US005466899A

United States Patent [19]

Geisenberger

[11] Patent Number: 5,466,899

[45] Date of Patent: Nov. 14, 1995

[54] ARRANGEMENT FOR ACTIVE SOUND DAMPING

[75] Inventor: Stefan Geisenberger, Straubing, Germany

[73] Assignee: Nokia Technology, Pforzheim, Germany

[21] Appl. No.: 348,739

[22] Filed: Dec. 2, 1994

[30] Foreign Application Priority Data

Dec. 10, 1993 [DE] Germany ..... 43 42 133.4

[51] Int. Cl.[6] ..... F01N 1/06

[52] U.S. Cl. ..... 181/206; 381/71

[58] Field of Search ..... 181/206; 381/71

[56] References Cited

U.S. PATENT DOCUMENTS

| | | | |
|---|---|---|---|
| 5,044,464 | 9/1991 | Bremigan | 181/206 |
| 5,272,286 | 12/1993 | Cain et al. | 181/206 |
| 5,336,856 | 8/1994 | Krider et al. | 181/206 |

FOREIGN PATENT DOCUMENTS

| | | |
|---|---|---|
| 0227372 | 7/1987 | European Pat. Off. . |
| 4027511 | 10/1991 | Germany . |
| 52-32974 | 9/1993 | Japan . |
| 836652 | 6/1981 | U.S.S.R. . |
| 9305282 | 3/1993 | WIPO . |

OTHER PUBLICATIONS

Foller, Dieter: Antischall–Chancen und Corenzen Ih: ATZ Automobiltechnische Zeitschrift 94, 1992, 2, S. 93.

*Primary Examiner*—Khanh Dang

*Attorney, Agent, or Firm*—Ware, Fressola, Van Der Sluys & Adolphson

[57] ABSTRACT

It is known in the state of the art to dampen noise emissions by means of "anti-sound". In the gas exhaust installations of combustion machines, this is realized most often in that the exhaust gas flowing in the gas exhaust installation is charged with "anti-sound" produced by loudspeakers (12). However, such arrangements are disadvantageous in that the flow of hot exhaust gases reduces the service life of the loudspeakers, or that such measures are insufficient for actively damping the sound. The invention therefore presents an arrangement that avoids the disadvantages that exist in the state of the art. According to the invention, this is achieved in that the gas exhaust tube (10) ends in one of the two chambers of a double chamber box (17), and that a bass reflex tube (21) protrudes into this chamber of the double chamber box (17). The excellent sound cancellation at low loudspeaker output is achieved because the sound cancellation takes place in the chamber of box (17), where the ends of the bass reflex tube (21) and the gas exhaust tube (10) terminate, and that the radiation axis S intersects the center line M in space A between the two tubes (10, 21) or in tube (21), and the distance L between the dividing wall (18) and center line M is 75% of the largest diameter extension of loudspeaker 12.

10 Claims, 2 Drawing Sheets

ARRANGEMENT FOR ACTIVE SOUND DAMPING

TECHNICAL FIELD

The invention concerns an arrangement for active sound damping, particularly one located for that purpose in thermally and chemically charged exhaust gas flows.

BACKGROUND OF THE INVENTION

In the state of the art, the concept of active sound damping means a measure whereby a noise which is phase-shifted by 180°, is superimposed on the noise to be dampened. Such arrangements, which operate according to the sound wave suppression principle, are generally designed so that a device acquires the noise to be dampened electroacoustically, and a signal processing device transfers it to a signal that is 180° phase-shifted with respect to the detected signal, before using the phase-shifted signal to control an electroacoustical converter.

If this principle is used for example to treat exhaust gas flows, such as occur in the exhaust equipment of combustion machines, in addition to the sound damping it must be ensured that the gas flow in the exhaust installation itself is not impaired by the acoustic radiation of the "anti-sound". To comply with this requirement, according to the state of the art, at least one acoustic converter in the form of a loudspeaker is so connected to the exhaust system, that a side of the diaphragm instead comes in direct contact with the exhaust gas flowing by. Such an arrangement is shown in greater detail in FIG. 2. This illustration of a principle shows a gas exhaust tube 10, in which exhaust gas (indicated by dots) coming from the combustion machine (not illustrated) flows in the direction of the arrow. Two opposing openings 11 are located on both sides of the gas exhaust tube 10. A cone loudspeaker 12 is placed into each of these openings 11 in such a way, that the diaphragms 13 of both loudspeakers 12 face each other, therefore the diaphragm sides 14 facing each other come in direct contact with the exhaust gases. The latter is made clear in that the exhaust gas also fills the areas B of loudspeaker 12, formed by the diaphragm cones 13. The rearward part of loudspeaker 12, and thus the part enclosing the magnet system 15, is surrounded by a housing 16, which encapsulates the loudspeakers with respect to the environment.

Although such an arrangement, whose loudspeaker 12 charges the sound in the gas exhaust tube 10 with sound signals that are phase-shifted by 180°, produces good sound cancellation in the gas exhaust tube, it is however considered a disadvantage that the loudspeaker diaphragms 13 of such an arrangement come in direct contact with the exhaust gas and the gas exhaust tube. This is because the exhaust gases are thermally and chemically charged, and these charges change the acoustic characteristics of the loudspeakers during operation on the one hand, and considerably shorten the useful life of the diaphragms 13 and their supports (not illustrated) on the other. Even the use of improved materials and costly adhesives for building suitable loudspeakers only solves the useful life problem insufficiently, as was proven by the applicant's tests, because the use of materials that are able to withstand temperature and chemicals is only conditionally possible, for acoustical reasons.

Another arrangement for active sound damping is known from the not yet published application DE 43 17 403.5. According to this arrangement, the "anti-sound" is produced in a loudspeaker box constructed according to the double chamber principle, and a bass reflex tube located in the front chamber of the box joins it to the gas exhaust line outside of the box. Although with such an arrangement the thermal and chemical charge of the loudspeaker diaphragm is small, such an arrangement requires exceptionally high sound pressures, so that continuous output of about 160 watts from the loudspeaker(s) is no rarity. In addition, the sound cancellation produced with this arrangement cannot be seen as optimum, because this arrangement produces a dipole radiator which exhibits interference phenomena in space, i.e. outside of the gas exhaust installation, and therefore does not produce sound cancellation in each space. Furthermore, the poor sound cancellation of the arrangement known from to DE 43 17 403.5 can also be attributed to the fact that the flow velocity inside the gas exhaust tube is significantly greater than the air moved by the diaphragm.

An arrangement is also known from PCT/GB92/01594, wherein the loudspeaker is located in the dividing wall of a box operating according to the double chamber principle. In this arrangement as well, the respective loudspeaker is located very far from the area where the cancellation of the sound waves, contained in the exhaust gas flow, takes place through the anti-sound produced by the loudspeaker. In other words, because of this large distance, the space that exists in publication PCT/GB92/01594 for guiding the sound waves emitted by the loudspeaker to the cancellation area, has the effect of a bass reflex tube shown in DE 43 17 403.5 so that the loudspeakers used in the arrangement according to PCT/GB92/01594 also require a high continuous output.

It is therefore the task of the invention to present an active sound damping system which avoids the disadvantages of the state of the art.

SUMMARY OF THE INVENTION

This task is fulfilled in that the dividing wall is arranged so that the radiation axis S of the loudspeaker, which is vertical to the dividing wall when a loudspeaker is installed in the dividing wall, intersects the part of the center line M that runs outside of the gas exhaust tube's output area, and that the distance E between the dividing wall area, in which the loudspeaker is located, and the intersection point of the radiation axis S with the center line M, is a maximum of 75% of the largest extension of the loudspeaker diameter.

The invention is based on the knowledge that the loudspeaker output required to cancel the sound can be considerably reduced, if the distance between the source of the sound and the anti-sound is small. In this connection, the inventor discovered that the sound pressure reduction of sound occurrences in flowing gases is smaller than the sound pressure reduction in non-flowing gases. The latter led to the fact that with a large distance from the sound or anti-sound source to the area where the two types of sound waves meet, the sound pressure level of the source located in a gas flow is high and the sound pressure of the other source, which is not exposed to any gas flow, has undergone a superproportional reduction. If the existing distances are not reduced, the superproportional reduction of the sound pressure level can only be compensated by charging the sound source that is not located in the gas flow with a higher output. In the inverse sense this also means that the reduction of the sound pressure level of the source not exposed to any gas flow cancels less, than if the distance between this source and the area in which the sound waves of both sources meet, is reduced. However, this reduction is not problem-free, because the (loudspeaker) source, which produces the sound waves for cancelling the sound waves in the exhaust gas flow, is faced with the hot exhaust gases. Therefore, the merit of the invention can be seen in that the inventor determined a distance E between loudspeaker and exhaust gas flow which, when maintained, guarantees an optimum service life of the loudspeaker and the sound cancellation. In this instance it is essential that the radiation axis S intersects the center line M in the indicated area.

If the radiation axis S intersects the center line M at an angle α between 20 and 90 degrees, preferably an angle between 20 and 60 degrees, it ensures that the loudspeaker located in the dividing wall is only thermally charged by the exhaust gas flow to a small degree.

If the angle is within the preferred range, the distance E can be lowered without any problem to a value that corresponds to the radius of the largest extension of the loudspeaker diameter. This reduction of the distance E to the respective radius of the loudspeaker is also possible if the angle α is greater than 60 degrees. However, in that case it was shown that at these angle values the service life of the loudspeaker is slightly reduced, and a somewhat worse sound cancellation takes place.

If the tube, which is inserted into the sound outlet opening, is a bass reflex tube, the box can very easily be tuned with this tube. In that case the bass reflex tube forms the end of the entire gas exhaust installation, since any extension of this tube beyond the size required to tune the box would result in an erroneous tuning, thereby also leading to a worsening of the sound cancellation.

Good transfer of the exhaust gases into the tube with good sound cancellation is provided, if space A is not longer than three centimeters.

BEST MODE FOR CARRYING OUT THE INVENTION

Figure 1:
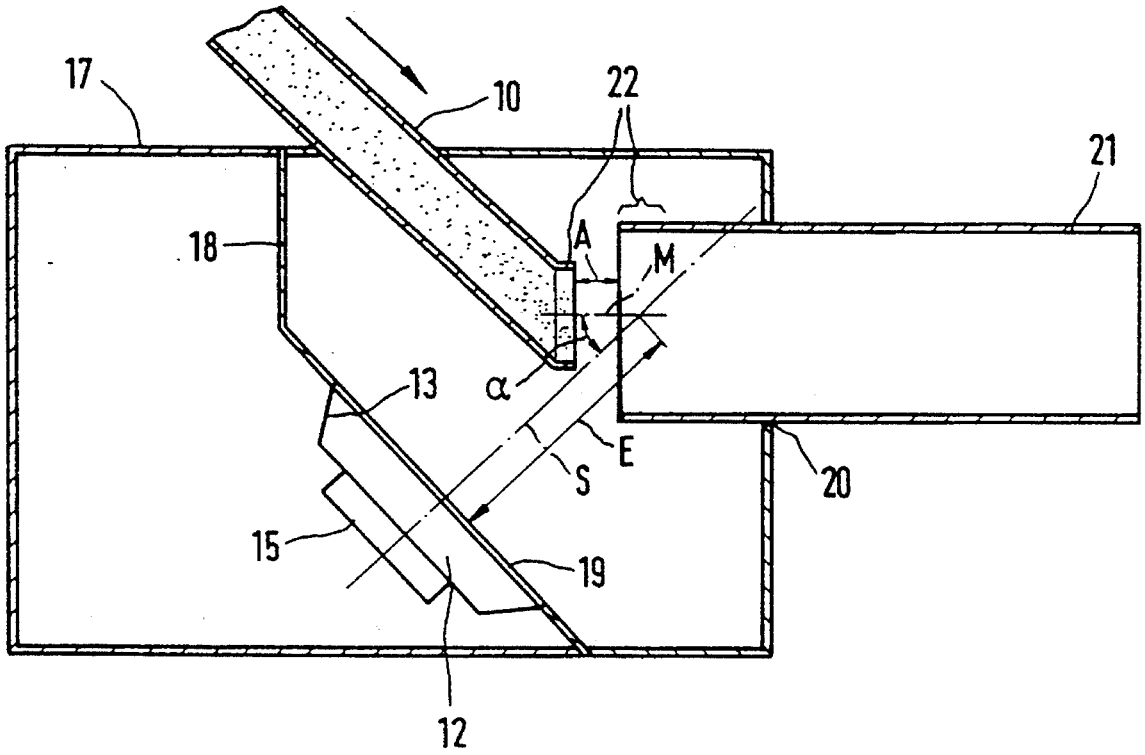
FIG. 1 depicts a cut through an active sound damping system.
Figure 2:
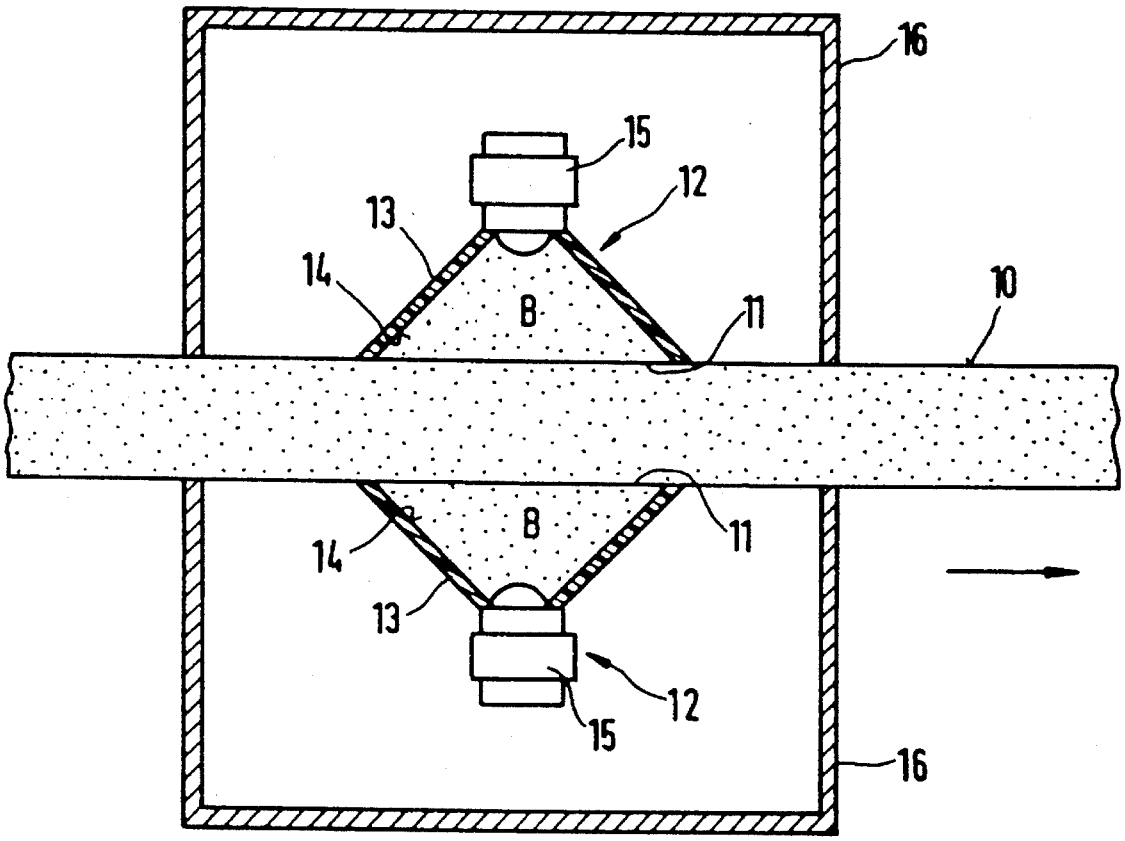
Fig. 2 PRIOR ART
FIG. 2 is an active sound damping system in accordance with the state of the art.

The invention is now explained by means of FIG. 1.

FIG. 1 is a cut through a loudspeaker box 17, which is divided into two different size volumes by a dividing wall 18. The dividing wall 18 has an opening 19 into which the loudspeaker 12 is inserted. In the configuration example depicted in FIG. 1, the diaphragm 13 of the loudspeaker 12 faces in the direction of the volume of box 17, which is equipped with sound outlet opening 20. The bass reflex tube 21 is inserted into the sound outlet opening 20, while the end of the bass reflex tube 21, which is nearest to the loudspeaker 12, protrudes into the inside of box 17. The other end of the bass reflex tube 21 forms the end of the entire gas exhaust installation, so that exhaust gases are released into the atmosphere after they leave the bass reflex tube.

The gas exhaust tube 10 also leads into the volume of box 17, where the bass reflex tube 21 ends, where the tube ends as well. The flow direction of the exhaust gases (illustrated by dots) is indicated by the arrow. FIG. 1 clearly shows that the gas exhaust tube 10 has a smaller inside diameter than the bass reflex tube 21, and the ends of the gas exhaust tube 10 and the bass reflex tube 21 are separated from each other by a space A. FIG. 1 further shows that the ends of gas exhaust tube 10 and bass reflex tube 21, which face each other, and which are also described as output areas 22, have the same center line M, so that, if we neglect the reciprocal space A between the two tubes 10, 21, we can talk about a coaxial arrangement of both tubes 10, 21.

A particularly good sound cancellation is ensured inside the box 17, by forming the dividing wall 18, in the area in which the loudspeaker 12 is located, so that the vertical radiation axis S of loudspeaker 12, which coincides with the symmetrical axis of loudspeaker 12, intersects the center line M, which runs through the output areas 22 of tubes 10, 21 and space A, outside of the output area 22 of the gas exhaust tube. In the configuration example depicted here, the intersection point lies between the radiation axis S and the center line M inside of tube 21. The angle α between the center line M and radiation axis S has a value of about 45°. Space A between the facing output areas is 2 cm. This value ensures that the exhaust gas flow, which runs at an angle to tube 21 in the gas exhaust tube 10 to the output area 22, is well taken over by tube 21.

In the depicted configuration example the distance L, which indicates the length of the radiation axis S between the dividing wall 18 and the intersection point of radiation axis S and center line M, is 75% of the largest diameter extension of loudspeaker 12. If the sound cancellation is to be increased further in another not illustrated configuration example, the distance L can be lowered to below 50% of the largest diameter extension of loudspeaker 12. But with values below 50% of the largest loudspeaker extension, it must be taken into account that the service life of the loudspeaker is considerably reduced because of the small distance between exhaust gas flow and loudspeaker 12. Nonetheless, the service life of loudspeaker 12 at that distance is still clearly above those of arrangements according to DE 43 17 403.5. This can be attributed to the fact that on the one hand the loudspeaker box 17 forms the end of the entire gas exhaust installation, therefore the hot exhaust gases are significantly cooled on the way from the combustion machine to the end of the gas exhaust tube, and furthermore because, according to the arrangement of the present application, the gas exhaust tube 10 is at a distance from the loudspeaker 12 in the front chamber of box 17, or the gas exhaust tube 10 is in a favorable flow condition with respect to the bass reflex tube 21. Also, the fact that the loudspeaker 12 inserted into box 17 operates at very low continuous output to cancel the sound, also has a temperature-reducing effect.

What is claimed is:

1. An active sound damping system for gas exhaust installations, with at least one loudspeaker (12) placed into the dividing wall (18) of a loudspeaker box (17) that operates in accordance with the double chamber principle, where one of the volumes formed by the dividing wall (18) is equipped with a sound outlet opening (20) into which a tube (21) is placed, and with a gas exhaust tube (10) ending in the volume formed by the dividing wall (18), which is equipped with the sound outlet opening (20), where the facing ends of both tubes (10, 21), which share the same center line M at least in their outlet area (22), are separated from each other by space A, characterized in that the dividing wall (18) is arranged so that the radiation axis S of a loudspeaker (12) inserted into the dividing wall (18) intersects the part of the center line M that runs outside of the outlet area (22) of the gas exhaust tube (10), and that the distance E between the area of the dividing wall (18), in which the loudspeaker (12) is located, and the intersection point on the center line M of the radiation axis S of loudspeaker (12), is a maximum of 75% of the largest extension of the loudspeaker diameter.

2. An active sound damping system as claimed in claim 1, characterized in that the radiation axis S and the center line M form an angle α between 20 and 90 degrees.

3. An active sound damping system as claimed in claim 2, characterized in that the distance E is equal to the radius of the largest extension of the loudspeaker diameter.

4. An active sound damping system as claimed in claim 3, characterized in that the tube (21) placed in the sound outlet opening (20) is a bass reflex tube, and that the end of the bass reflex tube (21) which faces away from the box (17), forms the entire end of the gas exhaust installation.

5. An active sound damping system as claimed in claim 4, characterized in that space A is not longer than three centimeters.

6. An active sound damping system as claimed in claim 1, characterized in that the distance E is equal to the radius of the largest extension of the loudspeaker diameter.

7. An active sound damping system as claimed in claim 2, characterized in that the tube (21) placed in the sound outlet opening (20) is a bass reflex tube, and that the end of the bass reflex tube (21) which faces away from the box (17), forms the entire end of the gas exhaust installation.

8. An active sound damping system as claimed in claim 1, characterized in that the tube (21) placed in the sound outlet opening (20) is a bass reflex tube, and that the end of the bass reflex tube (21) which faces away from the box (17), forms the entire end of the gas exhaust installation.

9. An active sound damping system as claimed in claim 3, characterized in that space A is not longer than three centimeters.

10. An active sound damping system as claimed in claim 1, characterized in that space A is not longer than three centimeters.

* * * * *